US007503465B2

(12) United States Patent
Ciavarella et al.

(10) Patent No.: US 7,503,465 B2
(45) Date of Patent: Mar. 17, 2009

(54) UNIVERSAL ADAPTER CLIP

(75) Inventors: Nick E Ciavarella, Seven Hills, OH (US); Mark E Rosendranz, Parma, OH (US); Martin O'Toole, Chagrin Falls, OH (US); Detlev F Smith, Fairlawn, OH (US)

(73) Assignee: Joseph S. Kanfer, Richfield, OH (US)

( * ) Notice: Subject to any disclaimer, the term of this patent is extended or adjusted under 35 U.S.C. 154(b) by 1084 days.

(21) Appl. No.: 10/693,534

(22) Filed: Oct. 25, 2003

(65) Prior Publication Data

US 2005/0087552 A1 Apr. 28, 2005

(51) Int. Cl.
*B67D 5/06* (2006.01)
*B65D 88/54* (2006.01)

(52) U.S. Cl. ..... 222/181.3; 222/325

(58) Field of Classification Search ..... 222/180–185.1, 222/325

See application file for complete search history.

(56) References Cited

U.S. PATENT DOCUMENTS 6,607,103 B2 * 8/2003 Gerenraich et al. ..... 222/183
D480,639 S 10/2003 Ciavarella et al.
6,758,372 B2 * 7/2004 Studer et al. ..... 222/88
6,845,888 B2 * 1/2005 Verherbrugghen et al. .. 222/162

* cited by examiner

*Primary Examiner*—Frederick C. Nicolas
*Assistant Examiner*—Melvin A Cartagena
(74) *Attorney, Agent, or Firm*—Renner, Kenner, Greive, Bobak, Taylor & Weber

(57) ABSTRACT

A universal adapter clip used in connection with a container that is received within a soap dispenser having a key-plate, the clip including a hollow body attachable to the container, a flange extending radially outward of the body, and a tab extending rearwardly from the body and axially spaced from the flange to receive the key-plate therebetween upon insertion of the container within the dispenser.

14 Claims, 4 Drawing Sheets

UNIVERSAL ADAPTER CLIP

RELATED PATENT APPLICATIONS

None.

FIELD OF THE INVENTION

The present invention generally relates to a dispenser having a housing in which a container filled with a product to be dispensed is removably received. More particularly, the present invention relates to dispensers that employ a keying system for matching a container to the appropriate dispenser. Most particularly, the present invention relates to a universal collar key that may be attached to the container and allow the container to be inserted in multiple dispenser housings despite any keying systems associated with those housings.

BACKGROUND OF THE INVENTION

Dispensers are commonly used to dispense fluids and powders such as lotions or soap, among others. For sake of simplicity, all dispensable products will be collectively referred to herein as "soap." These dispensers generally include a housing into which a container, such as a bag or bottle, containing the soap to be dispensed is inserted. To maximize the use of the volume within the housing, in terms of the soap stored, the container is often sized or contoured to fit a specific housing. Moreover, to ensure that only the proper container is used with the appropriate housing, a system of keying the containers to their appropriate housings has been developed.

One form of such a keying system incorporates a collar key that is attached to the container and interacts with a receiver within the housing to secure the container therein. To match the container to the housing, the collar key has projecting keys extending outwardly from its surface that are arranged to fit corresponding keyways formed in the receiver. For example, a container may have a collar key that includes a key in the form of an outwardly projecting vertical rib. The corresponding housing would have a keyway in the form of a vertically oriented slot sized to receive the vertical rib. By making alterations in the key shape, size or arrangement, containers have been made such that they will only fit a particular housing. In terms of manufacturing, this ensures that only the proper container is used with the proper housing. This is particularly important where the dispenser is labeled with particular identifying information and should be filled only with containers having the proper content. From the user's perspective, this allows the user to order the correct replacement container and ensure that its maintenance staff inserts the proper container in the proper housing.

Despite these advantages, the proliferation of dispensers has led to some consumers having several different dispensers; each requiring a different container with the appropriate key. As a result, these consumers are faced with purchasing containers with several different keys. While purchasing a single container to fit all of these housings may result in a loss of capacity in some of the dispensers, consumers have indicated that simplifying the stocking and replacement of containers by providing a universal container is desirable. Aside from choosing an appropriately sized container that could be received in all of these dispensers, to provide proper fit and securement of the container within the dispenser, a collar key that allows a single container to be used in multiple housings is needed.

SUMMARY OF THE INVENTION

In view of the foregoing, an object of the present invention is to provide a universal collar clip that may replace a collar key to fit a single container in multiple dispenser housings.

In light of this object, the present invention generally provides a universal adapter clip for securing a container within a soap dispenser irrespective of a key-plate within the dispenser, the clip includes a body attachable to the container, a pair of tabs extending rearwardly from the body, the tabs being insertable below the key-plate, and a rim formed on a top portion of the body, the rim extending over the key-plate, wherein the key-plate is received between the rim and the tabs.

The present invention further provides a universal adapter clip for securing a container within a soap dispenser, where the dispenser has a receiver, the universal adapter clip including a body attachable to the container; a pair of tabs extending rearwardly from the body, the tabs being insertable beneath the receiver; a rim formed on a top portion of said body the rim extending over at least a portion of the receiver, wherein the receiver is at least partially received between the rim and the tabs.

The present invention further provides a universal adapter clip for securing a container within a dispenser irrespective of a receiver within the dispenser, the clip including a semi-circular body open on one side to receive a portion of the container; an annular base defining an opening through which a nozzle of the dispenser extends; a pair of tabs extending rearward from the base, where the ends of the tabs step downward from the body to extend beneath the key-plate upon insertion; a top flange formed at an upper edge of the body and extending radially inward to engage a portion of the container and support the body thereon and radially outward to form a radially outward extending portion adapted to fit over the key-plate, wherein the rim and tabs receive the key-plate therebetween.

BRIEF DESCRIPTION OF THE PREFERRED EMBODIMENTS

Figure 1:
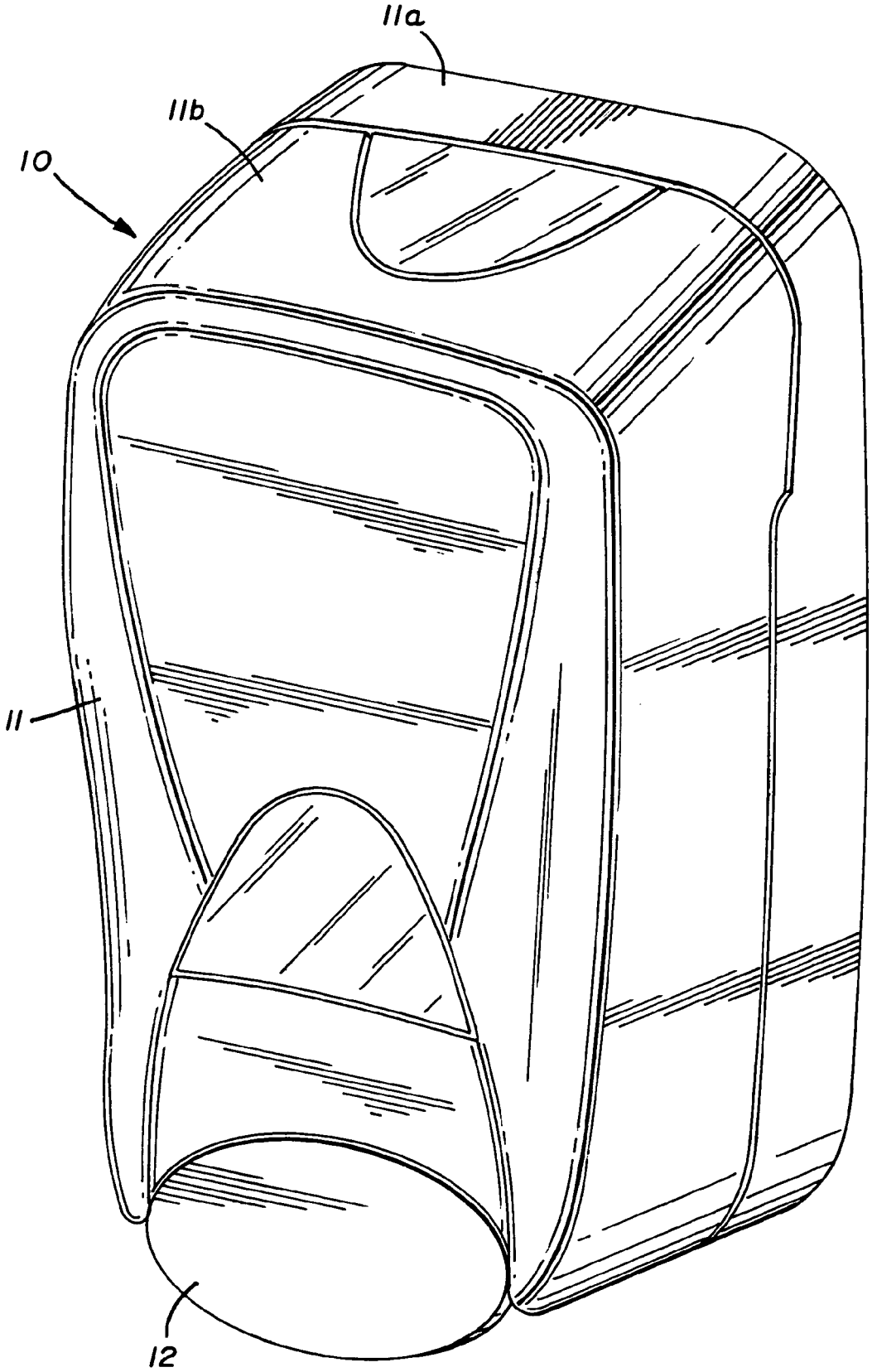
FIG. 1 is a perspective view of a dispenser according to the concepts of the present invention.

A dispenser, generally indicated by the numeral 10, is depicted in FIG. 1 of the drawings. Dispensers are widely available in the art and the dispenser 10 depicted in FIG. 1 is one example. The dispenser 10 generally includes a housing 11 that defines a recess 15 for receipt of a container 20, such as a bag or bottle, that holds soap. The housing 11 may include a base 11*a* and a cover 11*b* which may be attached to each other in a clamshell-like fashion to facilitate replacement of an empty container 20.

Figure 2:
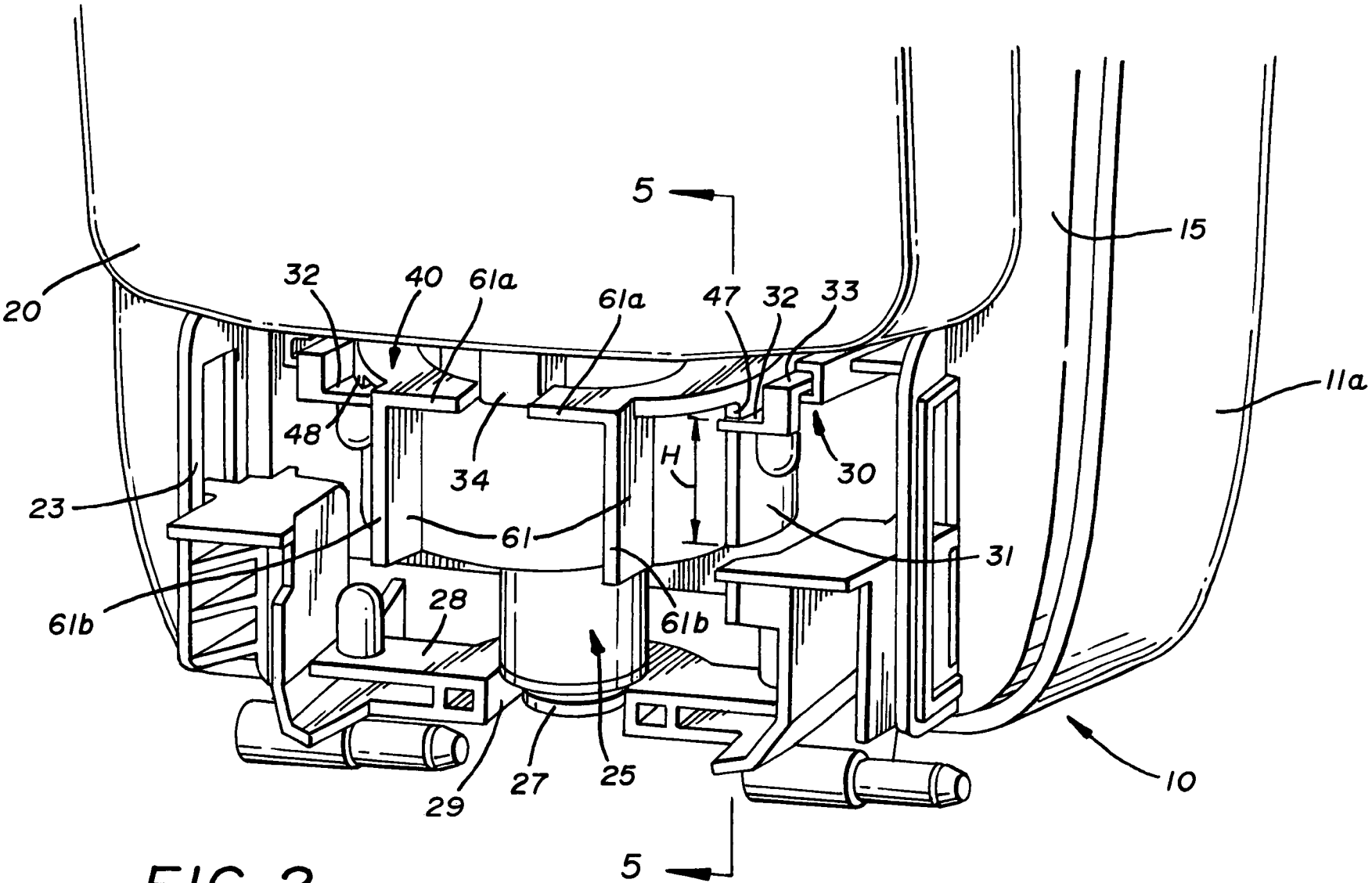
FIG. 2 is an enlarged perspective view of the dispenser depicted in FIG. 1 with the cover removed to show details of a universal adapter clip according to the concepts of the present invention attached to a pump extending from a container filled with soap.

As shown in FIG. 2, the base 11*a* may define the recess 15 into which at least a portion of a container 20 is received. The base 11*a* may further include a pair of shoulders that extend inward beneath the container 20 on either side of its neck 21.

Figure 3:
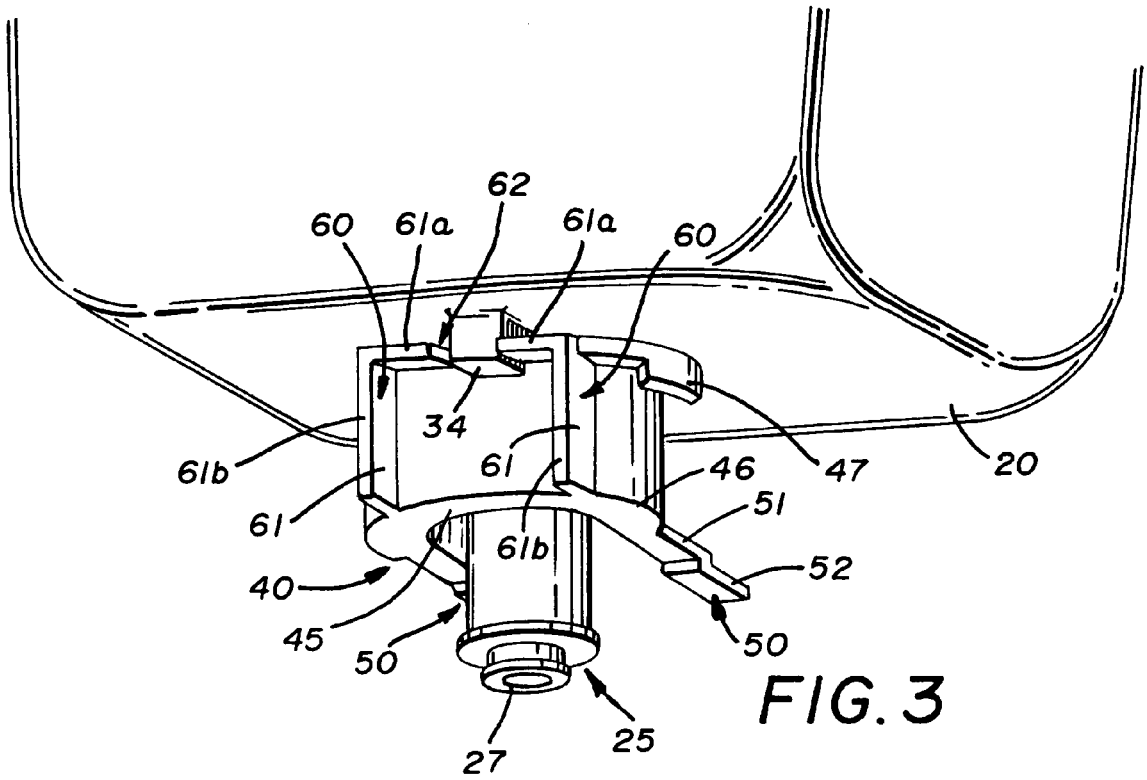
FIG. 3 is an enlarged perspective view of a pump extending from a container having a universal adapter clip according to the concepts of the present invention affixed thereto.
Figure 4:
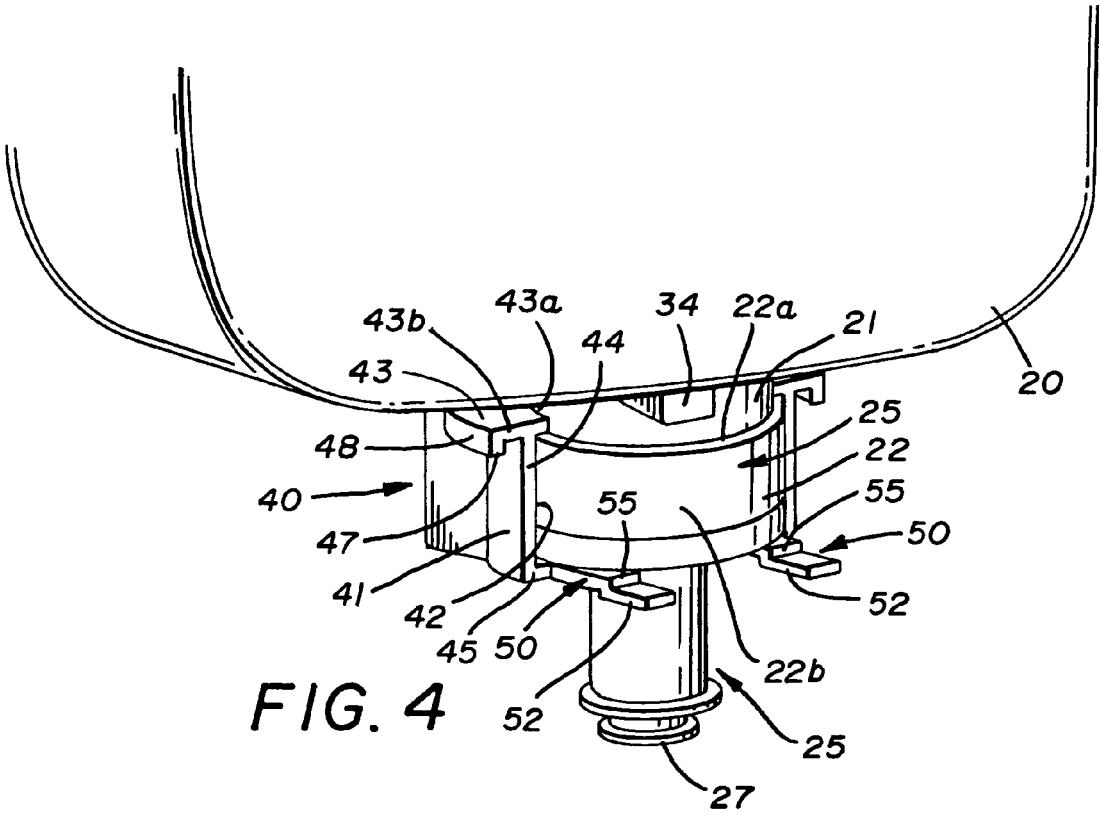
FIG. 4 is a rear perspective view of the pump, container, and universal adapter clip shown in FIG. 3.

A pump generally indicated by the numeral 25, is typically attached to or formed integrally with the container 20 for dispensing soap therefrom. As shown, pump 25 may extend downward from container 20. With reference to FIGS. 3 and 4, pump 25 may, for example, be attached to the container 20 at a neck 21 extending downwardly from container 20, as by a threaded cap 22 that fits over the pump 25 and threads onto the neck 21. The nozzle 27 of the pump 25 protrudes axially outward from the cap 22, and, in the example shown, is moved upward to dispense soap from the container 20.

Returning to FIG. 2, it may be seen that a nozzle locating bar 28 is located generally at the bottom of the base 11*a* and includes a recess 29 for receipt of the nozzle 27. To allow the pump 25 to be driven axially inward to pump soap from the container, the locator bar 28 is movable with the nozzle 27 and may be mounted on slide guides that limit the bar's movement in the axial direction. In this way, a handle 12 that interacts with the locator bar 28 may be used to move the nozzle 27 and dispense soap from the container 20. In the example shown, the handle 12 is pivotally attached to the cover 11*b* and includes rearwardly extending arms (not shown) that engage the locator bar 28 to vertically displace the nozzle 27 and actuate the pump 25.

Figure 5:
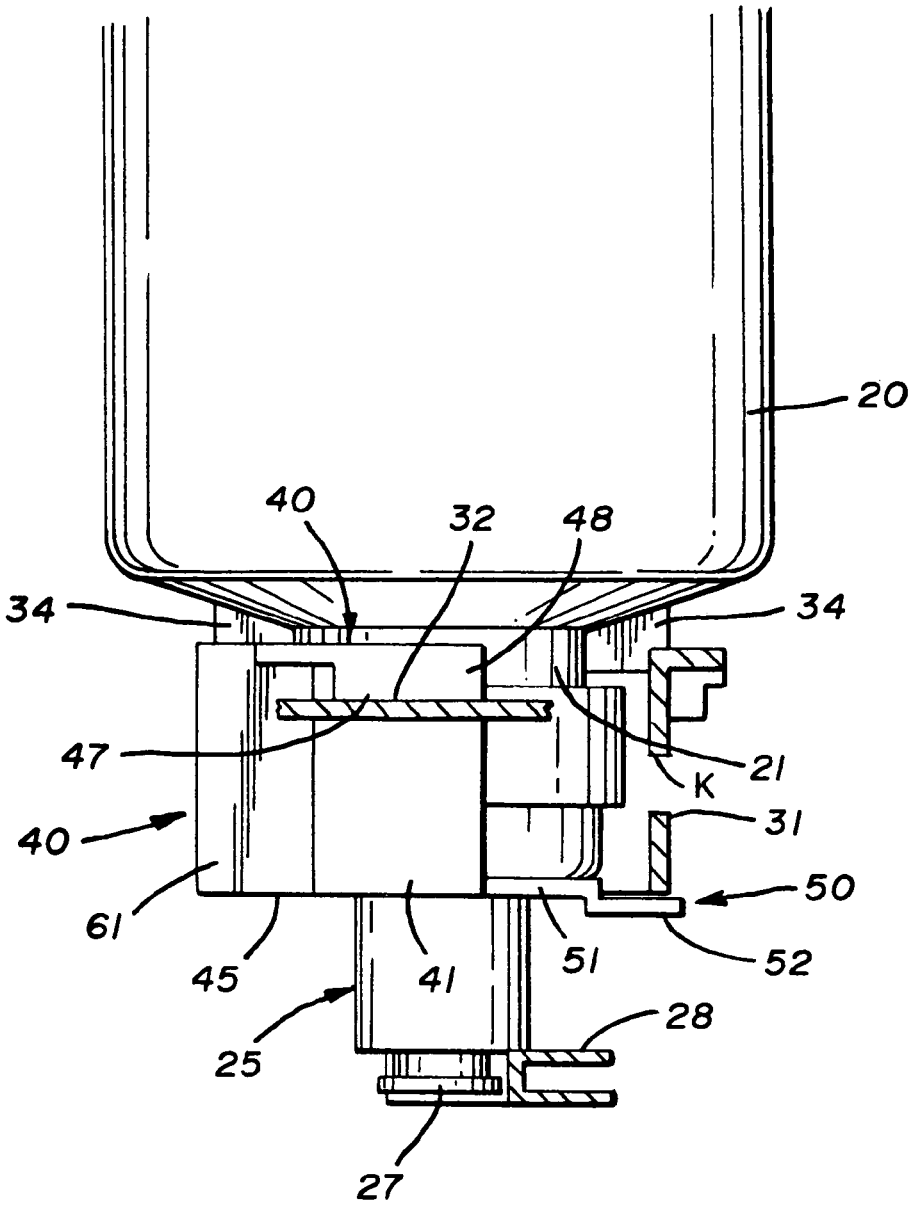
FIG. 5 is a side view of the pump, container and universal adapter clip.

A receiver 30 is located above the locating bar 28 and is generally adapted to receive a collar key. As discussed previously, existing dispensers employ collar keys to ensure a unique fit between a given container 20 and housing 11. Typically, the collar carries a projecting key, and the receiver 30 defines a keyway specific to a given collar key. As an example, the receiver 30, shown in FIG. 5, is depicted with a keyway K, which is in the form of a vertical slot. A matching collar key would have a vertical key extending therefrom and located such that the key would fit into the keyway K on the receiver 30. As will be appreciated, to key multiple containers 20 and housings 11, a variety of keyway arrangements have been established. With that in mind, a universal collar clip according to the concepts of the present invention is generally indicated by the numeral 40 in the drawings. Before describing the universal collar clip 40 in detail, it should be understood that the term "universal," as used herein, refers to the universal collar clip's ability to work with more than one receiver 30.

Returning to the receiver 30, it may include a key-plate 31 that may be shaped to receive the neck 21 of container 20. For example, as shown in FIG. 2, receiver 30 may have a C-shaped key-plate 31 defining a semi-circular opening into which the neck 21 and collar 40 may be received. A shelf 32 may be formed in receiver 30 and extend rearward above the key-plate 31. The shelf 32 like key-plate 31 may be semicircular. In the example shown, the shelf 32 is recessed from a top surface 33 of receiver 30 to generally form a semi-circular recessed area, with the shelf 32 extending radially outward behind the backing plate 31. In this way, the shelf 32 may provide some vertical support for the container 20.

A universal adapter clip 40 may snap or otherwise attach to a portion of the container 20, such as, the neck 21 or pump 25. With this attachment, the clip 40 may be retrofit to existing containers 20. In general, the clip 40 has a hollow body 41 that defines a bore 42 for receiving the portion of the container 20. In the example shown, the body 41 fits over the circular cap 22 that secures the pump 25 to the container 20. To provide for the circular shape of the cap 22, the bore 42 is made cylindrical. It will be appreciated that other bore shapes may be used to accommodate various container shapes.

A top flange 43 extends radially outward from the collar 40, for example, at or near the top edge 44 of body 41. As shown in FIG. 4, the flange 43 may have a radially inward extending portion 43*a* that extends inwardly into the bore 42 above the top edge 22*a* of the cap 22 such that the clip 40 may be supported on the cap 22 by grasping edge 22*a*. It will be appreciated that the flange 43 could be used to support the clip 40 on other projecting surfaces on container 20 or within the dispenser D. As best shown in FIG. 3, a bottom flange 45 may be formed at or near the bottom edge 46 of body 41. Bottom flange 45 may extend radially inward from the bottom edge 46 and be axially spaced from the top flange 43 a suitable distance for receiving the cap 22 therebetween. In this way, the cap 22 is essentially trapped between the top and bottom flanges 43, 45.

The top flange 43 may include a radially outward extending portion 43*b* that may rest on the seat 32 of receiver 30 to position the container 20 within the dispenser 10 and limit its axial movement. A rim 47 may extend downwardly from the end 48 of flange 43. In this example, the rim 48 contacts the seat 32 as shown in FIG. 2. Advantageously, the rim 47 may be used to improve the strength of the flange 43 such that the rim 43 is better able to carry the weight of the container 20.

To further position and secure the container 20, one or more tabs, generally indicated by the numeral 50, may extend rearwardly from the body 41 toward the base 11*a* of the housing 11. Tabs 50 are axially spaced from the flange 43 a distance that corresponds to the height H of key-plate 31, such that as the flange 43 fits over the key-plate 31, the tabs 50 are inserted beneath the key-plate 31 such that the key-plate 31 is trapped therebetween. The exposed keyless surface 22*b* of cap 22 may fit directly against the key-plate 31. The interaction of the tabs 50 and/or flange 43 with key-plate 31 axially restricts movement of container 20 while bypassing any keying system.

As best shown in FIG. 3, the tabs 50 may extend from the bottom flange 45 in a direction parallel to the insertion of the container 20. In the example shown, a first portion 51 of the tab 50 extends at the same level as bottom flange 45 a distance that places the end of first portion 51 generally in line with the surface 22*b* of the cap. In the example of a semi-circular body 41, first portion 51 extends a distance approximately equal to the radius of the cap 22. A second portion or end 52 of the tab 50 is stepped downward from the level of the first portion 51 creating a shoulder 55 that extends perpendicular to the direction of insertion. Upon insertion, the ends 52 of tabs 50 fit under the key-plate 31 and the shoulders 55 abut the key-plate 31 to ensure that the container 20 is not over inserted.

To facilitate insertion of the container 20, one or more hold, generally indicated by the numeral 60, may be provided on the clip 40. Hold 60 may be any positive or negative surface that facilitates grasping of the clip 40 and may include forwardly projecting ribs 61 as shown in FIG. 3. Ribs 61 may be L-shaped, as shown, and include a first leg 61*a* that extends generally horizontally along the top edge 44 of the body 41 and in line with flange 43. A second leg 61*b* may extend downward from the first leg at a perpendicular angle toward the bottom edge of the body 41. When two holds 60 are used, as shown in the present example, first legs 61*a* may be spaced from each other to define a recess 62 in which a locating projection 34 on the container 20 is received. In this way, a clip 40 may be quickly aligned with the container 20 to attach the clip 40 in the proper position for insertion.

In use, the clip 40 is attached to the container 20 and the container 20 is inserted into the housing 11. Since the flange 43 and tabs 50 used to locate and secure the bottle extend above and below the key-plate 31, the container 20 may be fully inserted without regard to a particular keyway K formed on the key-plate 31. In this way, the container 20 may be used with more than one dispenser 10 irrespective of the particular keying systems present in those dispensers.

While a full and complete description of the invention has been set forth in accordance with the dictates of the Patent Statutes, it should be understood that modifications can be resorted to without departing from the spirit hereof or the scope of the appended claims.

What is claimed is:

1. A universal adapter clip used in connection with a container that is received within a soap dispenser having a key-plate, the clip comprising:

a) a hollow body attachable to the container;

b) a flange extending radially outward from said body; and c) a tab extending rearwardly from said body and axially spaced from said flange to receive the key-plate therebetween upon insertion of the container within the dispenser.

2. The universal adapter clip of claim 1, wherein said flange is located at an upper vertical extremity of said body and said tab is located at a lower vertical extremity of said body.

3. The universal adapter clip of claim 1 further comprising a rim extending downwardly from a radial outer extremity of said flange, wherein said rim is adapted to contact a top surface of the key-plate.

4. The universal adapter clip of claim 3, wherein said tab includes a first portion extending rearward from said body and a second portion extending rearward from said first portion and stepped downward relative to said first portion.

5. The universal adapter clip of claim 4, wherein said first portion and said second portion form a vertically extending shoulder adapted to engage the key-plate upon insertion.

6. The universal adapter clip of claim 1, wherein said body is semi-circular and opens rearwardly relative to the dispenser.

7. The universal adapter clip of claim 1, wherein said body is opened at either axial end and adapted to receive a portion of the container therethrough.

8. The universal adapter clip of claim 7, wherein said flange includes a radially inward extending portion adapted to grasp a projecting surface on the container.

9. A universal adapter clip of claim 1 that defines a notch adapted to receive a locating projection on the container.

10. The universal adapter clip of claim 1 further comprising a hold formed on said body.

11. The universal adapter of claim 10, wherein said hold includes a pair of vertically extending ribs extending forwardly from said body opposite the key-plate.

12. A universal adapter clip for securing a container within a soap dispenser, where the dispenser has a receiver, the universal adapter clip comprising a body attachable to the container; a pair of tabs extending rearwardly from said body, said tabs being insertable beneath the receiver; a rim formed on a top portion of said body said rim extending over at least a portion of the receiver, wherein the receiver is at least partially received between said rim and said tabs.

13. A universal adapter clip for securing a container within a soap dispenser, where the dispenser has a key-plate, the universal adapter clip comprising a semi-circular body open on a rearward side to receive a portion of the container; an annular base defining an opening through which a nozzle of the dispenser extends; a pair of tabs extending rearward from said bottom flange, wherein each end of said tabs steps downward from said bottom flange to extend beneath the key-plate upon insertion; a top flange formed at an upper edge of said body extending radially inward to support said body on a portion of the container and extending radially outward to form a radially outward extending portion adapted to fit over the key-plate, wherein said radially outward extending portion and said end of said tabs are axially spaced to receive the key-plate therebetween.

14. The universal adapter clip of claim 13 further comprising a rim extending downward from said top flange, wherein said rim is adapted to engage a top surface of said key-plate.

* * * * *

UNITED STATES PATENT AND TRADEMARK OFFICE

CERTIFICATE OF CORRECTION

PATENT NO. : 7,503,465 B2
APPLICATION NO. : 10/693534
DATED : March 17, 2009
INVENTOR(S) : Nick E. Ciavarella et al.

It is certified that error appears in the above-identified patent and that said Letters Patent is hereby corrected as shown below:

On the title page, item (75), reading "Mark E. Rosendranz" should read "Mark E. Rosenkranz"

Signed and Sealed this

Twelfth Day of May, 2009

JOHN DOLL
*Acting Director of the United States Patent and Trademark Office*